US006135334A

United States Patent [19]

Seichter

[11] Patent Number: 6,135,334

[45] Date of Patent: Oct. 24, 2000

[54] BACKPACK ATTACHMENT DEVICE

[76] Inventor: Daniel Robert Seichter, 270 Ward St., Wallingford, Conn. 06492

[21] Appl. No.: 09/140,000

[22] Filed: Aug. 26, 1998

[51] Int. Cl.[7] ..... A45F 3/04; A45F 3/08

[52] U.S. Cl. ..... 224/651; 224/262; 224/250; 224/263; 224/630; 224/635

[58] Field of Search ..... 224/651, 650, 224/250, 630, 633, 635, 636, 259, 261, 262, 263, 153; 126/29, 30

[56] References Cited

U.S. PATENT DOCUMENTS

| | | | |
|---|---|---|---|
| 139,731 | 6/1873 | Palmer . | |
| 4,040,548 | 8/1977 | Guglielmo | 224/262 |
| 4,251,015 | 2/1981 | Gale, Jr. . | |
| 4,418,854 | 12/1983 | Genovese . | |
| 4,809,892 | 3/1989 | Chinski et al. . | |
| 5,277,349 | 1/1994 | Rowe . | |
| 5,560,524 | 10/1996 | Brune . | |
| 5,615,812 | 4/1997 | Martin | 224/153 |
| 5,826,771 | 10/1998 | Peng | 224/651 |

*Primary Examiner*—Stephen P. Garbe
*Attorney, Agent, or Firm*—Bachman & LaPointe, P.C.

[57] ABSTRACT

The present invention relates to a device for increasing the storage capability of a pack. The device comprises a frame, a plurality of adjustable straps connected to the frame for holding a plurality of articles, such as bedrolls, blankets, sleeping bags, tents, etc., and a plurality of straps and hooks for attaching the device to the pack. In a preferred embodiment of the present invention, the frame is formed by a number of fabric members sewn and stitched together so as to form a lightweight construction. Preferably, the members are stitched together so as to form pockets along the sides of the frame and an interior storage space across the top of the frame. One or more U-shaped members, preferably formed from a metallic material, may be inserted into the pockets and the storage space so as to rigidify the frame. When taken out of the pockets and the interior storage space, the U-shaped members may be used by a camper/hiker to hold pots or the like over a camp fire.

16 Claims, 6 Drawing Sheets

BACKPACK ATTACHMENT DEVICE

BACKGROUND OF THE INVENTION

The present invention relates to a device for increasing the storage capacity of a pack such as a backpack.

Hiking and camping have become popular recreational activities in recent years. Most hikers/campers carry the items they require for camping within a gear pack such as a backpack. Such gear packs are well known in the art. U.S. Pat. No. 139,731 to Palmer, for example, illustrates a knapsack for use by military personnel. As shown therein, bedrolls or blankets to be used in the field may be carried on top of the knapsack and held in place by a series of straps.

U.S. Pat. No. 4,809,892 to Chinski et al. illustrates a different type of gear pack, namely an artist's kit, which includes a storage compartment unit. The storage compartment unit has a plurality of pockets for storing various artist's painting and drawing supplies. The storage compartment unit also has a cover and a plurality of straps for securing the storage compartment and the cover to seat bushings when a seat being carried by the user is disassembled. The storage compartment unit further includes a plurality of straps whereby the seat, easel, and storage compartment unit may be carried as a unitary backpack. A canvas carrying apparatus is provided for transporting a framed canvas on the backpack.

U.S. Pat. No. 4,418,854 to Genovese illustrates a backpack shelter apparatus which incorporates a backpack, frame means, shelter and shelter support means adjustably coupled to the frame means. The shelter support means can be extended from the frame means to provide support for the shelter, backpack and frame means. The shelter unfolds from the frame means and is erected to provide an enclosure wherein the backpack is in an upright position and a person can be protected from the elements.

U.S. Pat. No. 5,277,349 to Rowe illustrates a combination backpack and tent system which utilizes the backpack frame as the support for one end of the tent. The tent is secured to the lower end of the backpack frame so that it can be rolled up and stored on the frame, covered by a short flap constituting an extension of the floor.

U.S. Pat. No. 5,560,524 to Brune relates to a combination gear pack and pivotable seat member. The seat member is connected at the bottom of the gear pack and is pivotable between various positions with respect to the front and the rear of the pack. Straps support the seat member from the pack. The straps are adjustable so that the angular orientation of the seat member with respect to the pack can be adjusted for comfort to the user. The seat member, when not in use as a chair, can also be swung back to compressively secure a load against the pack.

U.S. Pat. No. 4,251,015 to Gale, Jr. illustrates a frame apparatus for use as a backpack frame in one configuration and as a tent frame in another configuration. The frame members are shaped and sized so as to nest within each other in the backpack configurations.

The capacity of an ordinary pack, and thus the quantity of supplies which can be carried in it, are limited. It is difficult for pack users to carry bulky items such as bedrolls, sleeping bags, blankets, and tents within the pack itself because they decrease the amount of space available for other supplies. Thus, there remains a need for a device which increases the storage capability of a gear pack and allows hikers/campers to conveniently carry bulky items such as the aforementioned items externally of the pack.

SUMMARY OF THE INVENTION

Accordingly, it is an object of the present invention to provide a device for increasing the storage capability of a gear pack.

It is a further object of the present invention to provide a device as above which is both lightweight and easy to use.

It is yet another object of the present invention to provide a device as above which may be easily joined to a gear pack.

The foregoing objects are attained by the device of the present invention.

In accordance with the present invention, a device for increasing the storage capability of a pack comprises a frame, means connected to the frame for holding a plurality of articles, such as bedrolls, blankets, sleeping bags, tents, etc., and means for attaching the device to the pack. In a preferred embodiment of the present invention, the frame is formed by a number of fabric side and cross members sewn and stitched together so as to form a substantially rectangular, lightweight construction. The fabric pieces forming the side members are preferably stitched together so as to form interior pockets along the sides. The fabric pieces forming an uppermost one of the cross members is stitched together so as to form an interior space across the top of the frame. One or more U-shaped members, preferably formed from a metallic material, may be inserted into the interior pockets and the interior space so as to rigidify the frame. When taken out of the pockets and the interior space, the U-shaped members may be used by a camper/hiker to hold pots or the like over a camp fire.

The means for holding a plurality of articles to the frame preferably comprises a plurality of adjustable straps, with connect/disconnect devices, attached to the side members of the frame.

The means for attaching the device to the pack also preferably comprises a plurality of adjustable straps attached to the frame. Each of the straps is provided with a means for engaging a portion of the pack such as a D-ring or a waistband.

Other details of the present invention, as well as other objects and advantages attendant thereto, are discussed in detail in the following description and the accompanying drawings wherein like reference numerals depict like elements.

DETAILED DESCRIPTION OF THE PREFERRED EMBODIMENT(S)

Figure 1:
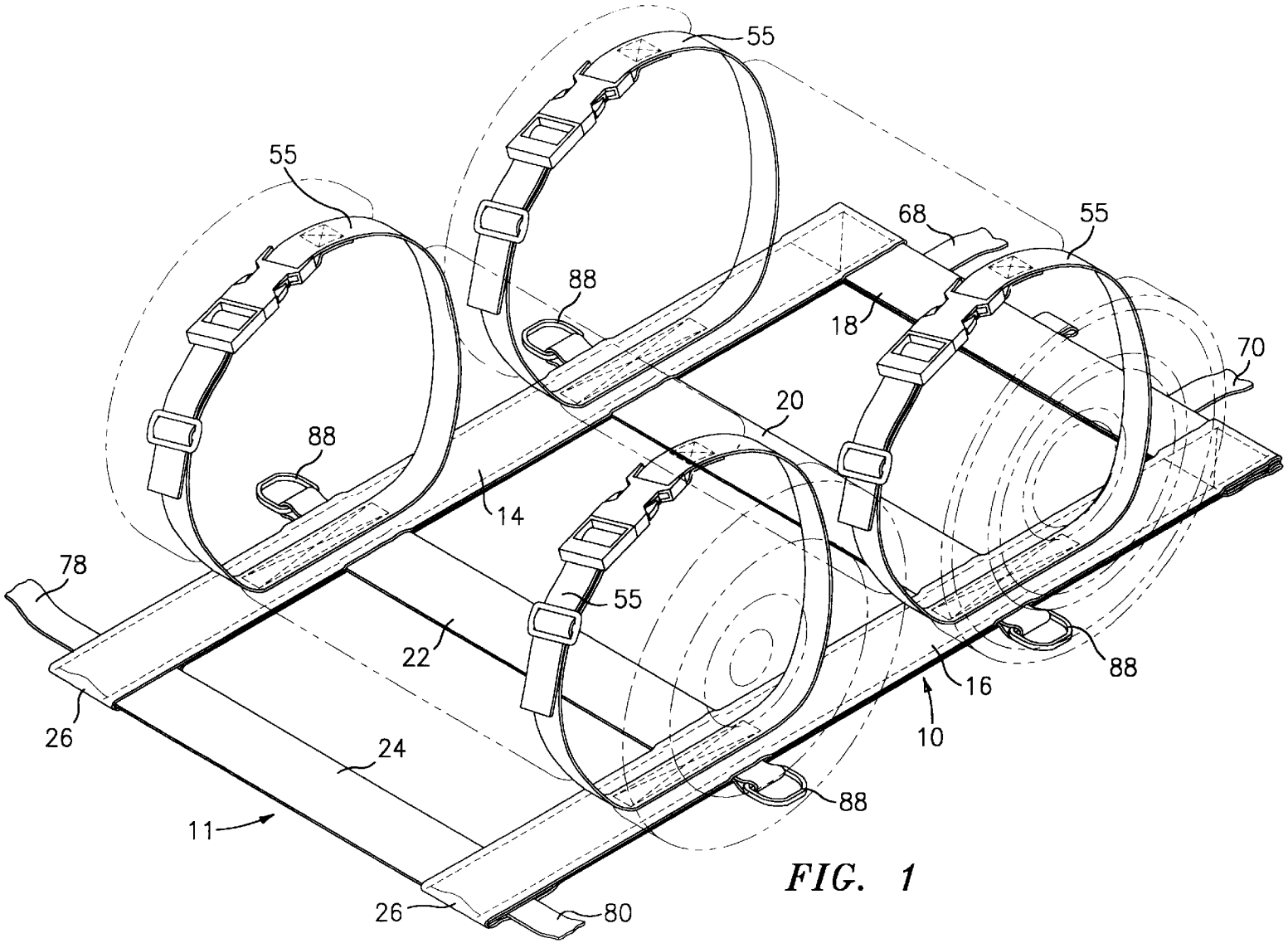
FIG. 1 is a perspective view of the attachment device of the present invention.
Figure 2:
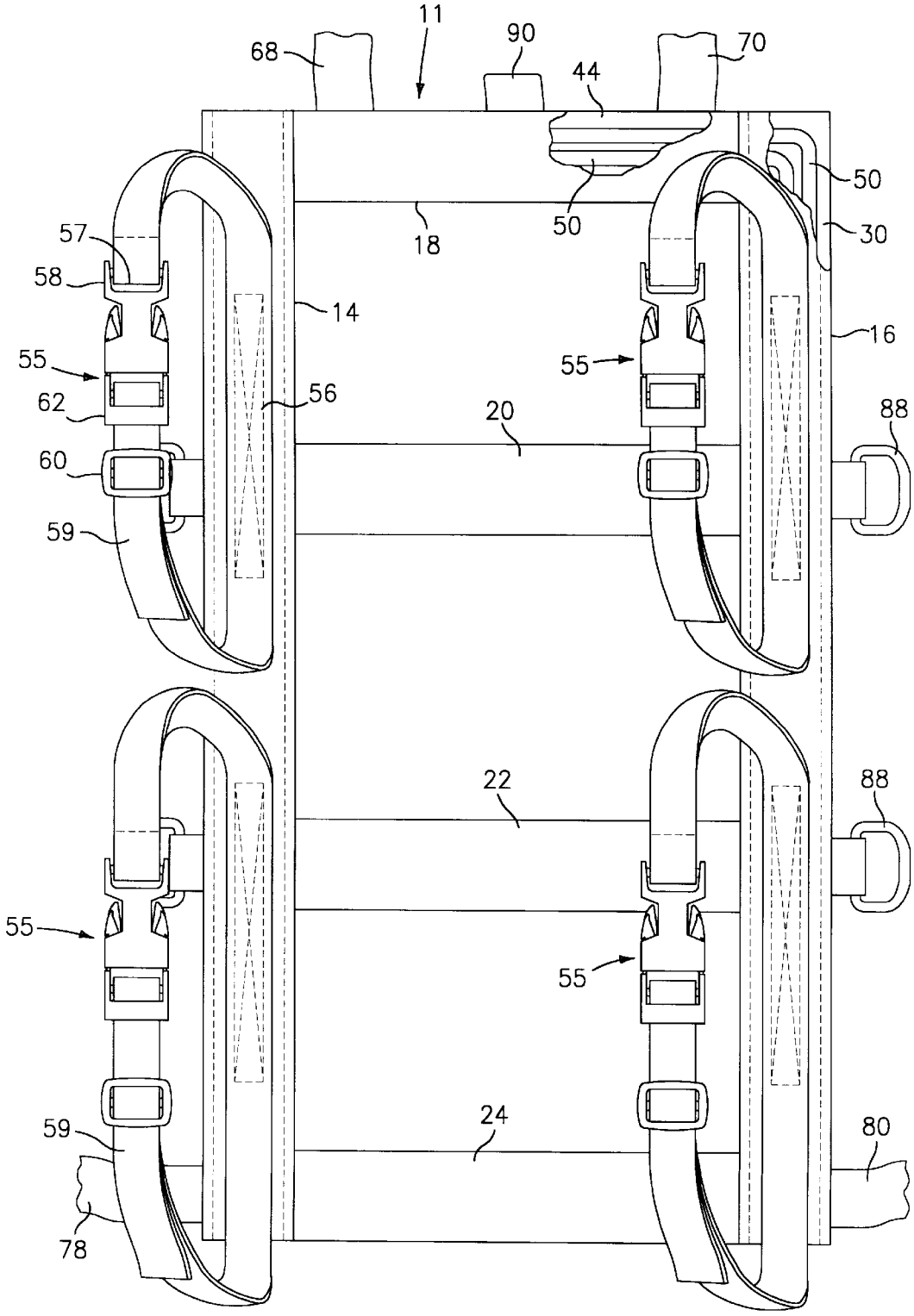
FIG. 2 is a top view of the attachment device of FIG. 1.

Referring now to the drawings, FIGS. 1 and 2 illustrate a device 10 for increasing the storage capacity of a pack 12 such as a backpack, a fanny pack, or a gear pack. The device 10 includes a frame 11 having a substantially rectangular shape when laid flat. The frame 11 is formed by two spaced apart side members 14 and 16 and a plurality of cross members 18, 20, 22 and 24 which are arranged substantially perpendicular to the side members 14 and 16. While the frame 11 has been shown as having four cross members, it should be recognized that it could be formed with less than or more than four cross members.

Each of the cross members 18, 20, 22 and 24 is joined at its opposite ends to the side members 14 and 16. While the cross members 18, 20, 22 and 24 may be joined to the side members 14 and 16 in any desired manner, it is preferred to join them to the side members by sewing or stitching.

Figure 3:
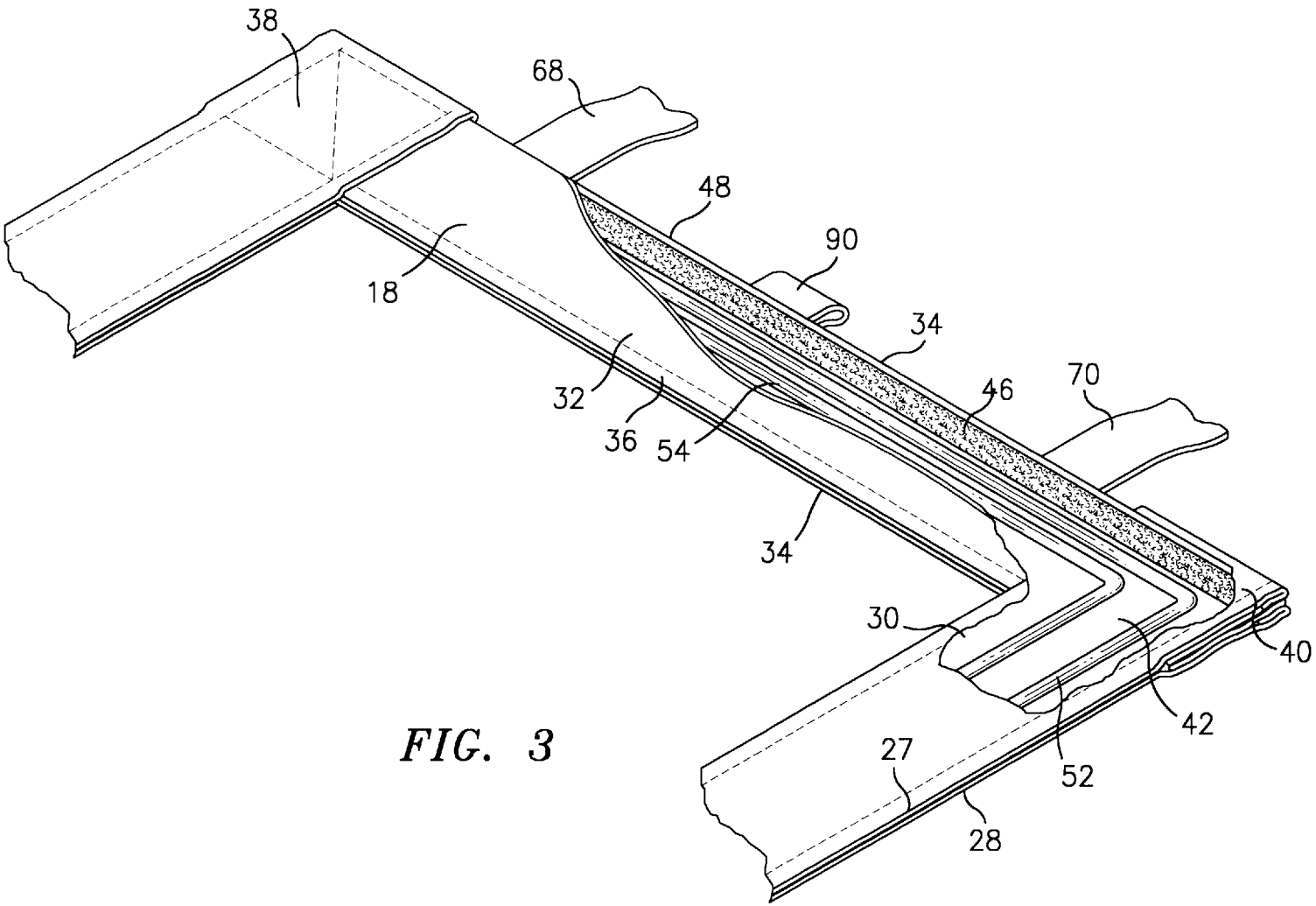
FIG. 3 is a partial sectional view of a portion of the attachment device of FIG. 1.

As shown in FIGS. 1–3, each side member 14 and 16 is formed by a piece of a flexible fabric 26, such as polypropylene strapping or nylon webbing, which is folded on itself so as to form two layers 27 and 28 of material. The folded over portions of the fabric 26 or layers 27 and 28 are sewn or stitched together along their edges to form the respective side members 14 and 16. The folded over portions are preferably sewn or stitched so as to form an interior pocket 30 in each side member 14 and 16. While it is preferred to form each side member 14 and 16 from a single piece of folded over fabric, it is possible to form each side member 14 and 16 from two pieces of fabric which are sewn together.

As shown in FIG. 3, the uppermost cross member 18 is also formed by two flexible fabric pieces or layers 32 and 34 which are sewn or stitched together along a lower edge 36 except in the regions 38 and 40. The two fabric pieces 32 and 34 are not stitched or sewn together in the regions 38 and 40 so as to provide access openings 42 to the interior pockets 30. The fabric pieces 32 and 34 when joined together form an interior space 44. Closure means 46, as shown in FIG. 3 may be provided adjacent an upper edge 48 of each piece 32 and 34. The purpose of the closure means 46 is to close access to the interior space 44. The closure means can comprise any suitable closure means known in the art such as pieces of VELCRO-type material attached to the interior surfaces of the fabric pieces 32 and 34.

Each of the lower cross pieces 20, 22 and 24 is preferably formed from a single piece of a flexible fabric material, although each piece could be formed from multiple pieces of fabric material if so desired to provide the frame with additional strength to resist separation.

Figure 4:
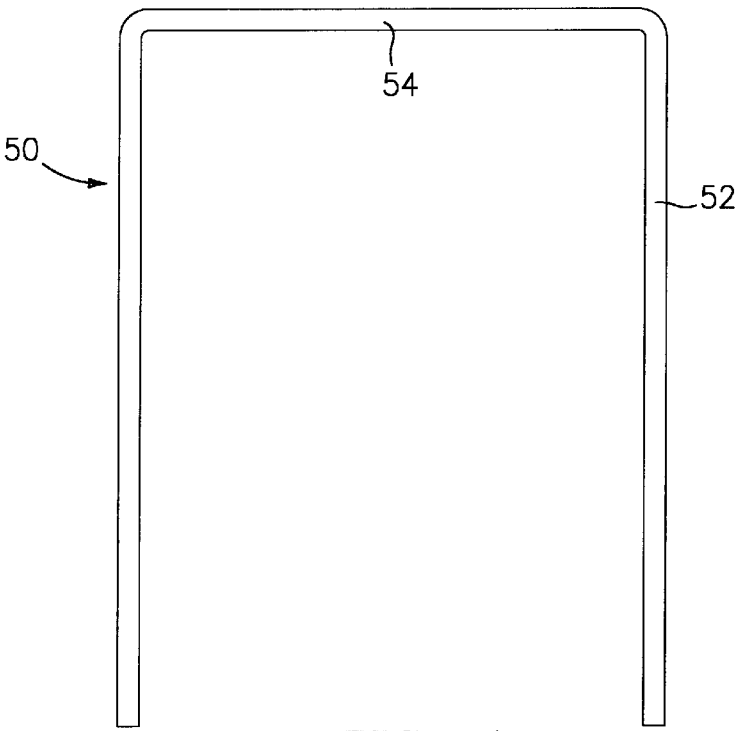
FIG. 4 is a front view of a substantially U-shaped member used to rigidify the device of the present invention.

As shown in FIG. 2–4, at least one substantially U-shaped member 50 having integrally formed legs 52 and cross piece 54 is positioned within the interior pockets 30 and the interior space 44. The U-shaped member 50 may be formed from any suitable metallic material known in the art. When positioned within the pockets 30 and the interior space 44, the substantially U-shaped member(s) 50 serve(s) to make the frame 11 more rigid. When removed from the interior space 30 and the pocket 44, the U-shaped member(s) may be used for a number of purposes including holding pots/pans over a camp fire. Typically, two U-shaped members (50) are stored within the pockets 30 and the interior space 44.

While it is preferred to store the U-shaped member(s) 50 in the pockets 30 and the interior space 44, other objects can be stored in these compartments. Further, the U-shaped member(s) may be omitted if desired.

Referring now to FIG. 2, the device 10 of the present invention is designed to hold a number of bulky items such as a bed roll, sleeping bag, blanket and/or tent. To this end, each side member 14 and 16 is provided with two adjustable strap arrangements 55. Each strap arrangement 55 is formed by a piece of fabric 56 attached to the respective side member 14 or 16. The fabric 56 may be attached to the side member 14 or 16 in any desired manner such as by an adhesive and/or by sewing or stitching. A first end 57 of each piece of fabric is looped around part of a quick connect/disconnect device 58 such as a spindle and then joined to a portion of the fabric 56 by sewing or stitching. A second end 59 of the fabric is passed through a buckle 60, looped about a portion of a quick connect/disconnect device 62 such as a spindle, and back through the buckle 60. When the quick connect/disconnect device 58 is mated with the quick connect/disconnect device 62, a closed loop is formed which as shown in FIG. 1 surrounds an object to be held by the device 10. The size of the loop can be adjusted by adjusting the second end 59 of the fabric. The quick connect/disconnect devices 58 and 62 may comprise any suitable connection device known in the art.

While the drawings show the side members 14 and 16 as having two adjustable strap arrangements 55 for holding two objects, one could provide additional adjustable strap arrangements to hold additional objects.

Figure 5:
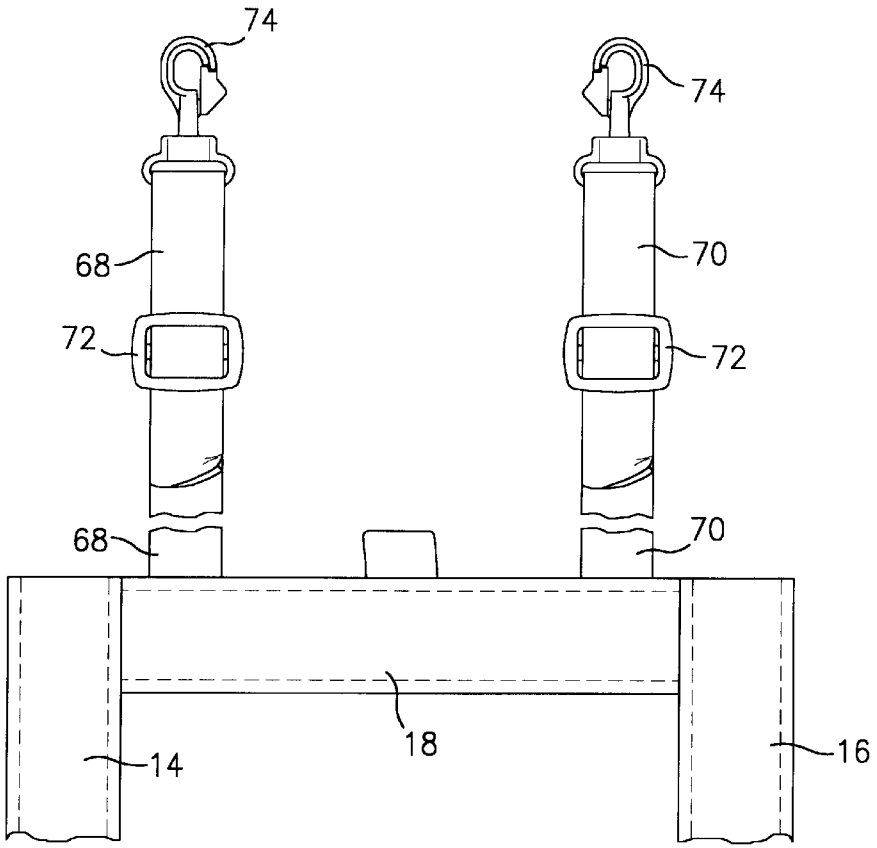
FIG. 5 is a top view of a portion of the device of FIG. 1 showing the upper straps for joining the device to a pack.

The device 10 is intended to be removably secured to the pack 12. To this end, a pair of straps 68 and 70 are attached to the uppermost cross member 18 as shown in FIG. 5. Each strap 68 and 70 is preferably adjustable in length and is formed by a piece of flexible fabric joined at one end to one of the fabric pieces 32 and 34. The flexible fabric may be joined to fabric piece 32 or 34 by sewing or stitching or by some other means such as an adhesive. The second end of the fabric forming each strap 68 and 70 is looped around the end of a hook or other closable latch means 74. A buckle 72 is provided to allow the length of each strap to be adjusted. As before, the strap 68 or 70 passes through the buckle 72, is looped around an end of the latch means 74, and is then passed back through the buckle 72 in a standard and well known manner. Each hook or closable latch means 74 connects to a respective D-ring or other connection device (not shown) on the pack 12.

Figure 6:
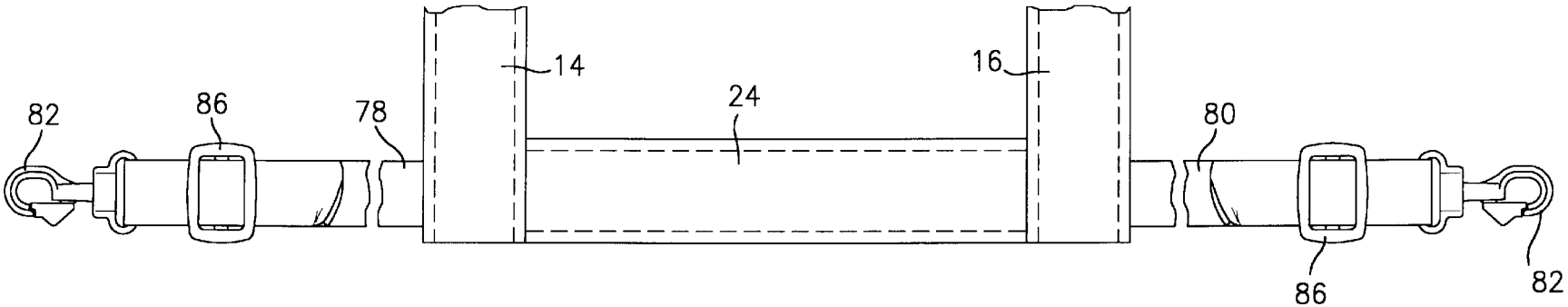
FIG. 6 is a top view of a portion of the device of FIG. 1 showing the lower straps for joining the device to a pack.

Referring now to FIG. 6, two adjustable straps 78 and 80 are attached to the lower ends of the side members 14 and 16. The straps 78 and 80 also have a hook or closable latch device 82 which mate capable of mating with D-rings (not shown) on the pack 12 or the waistband 84 of the pack. The straps 78 and 80 are each formed by a piece of flexible fabric material joined to a respective one of the side members 14 and 16. The fabric material may be joined to the side member 14 or 16 in any desired manner, such as by sewing or stitching or by an adhesive. A buckle 86 is provided to allow each strap 78 and 80 to be adjustable in length. As before, a loose end of each strap is passed through the buckle 86, looped around an end of the latch device 82, and then passed back through the buckle.

If desired, one or more D-rings 88 may be attached to each side member 14 and 16. The D-rings 88 provide the ability to attach larger items, such as a flat first aid kit, to the device 10 and may be used in conjunction with the straps 55 or other connection devices (not shown). The D-rings 88 may be attached to each of the side members 14 and 16 in any desired manner such as by sewing or stitching.

A tab 90 formed from a flexible fabric material may be attached to the uppermost cross member 18. The tab 90 facilitates the opening and closing of the interior space 44. If desired, the tab 90 may be used to hang the device 10 from a hook or other support structure. The tab 90 may be attached to the cross member 18 in any desired manner known in the art such as by stitching.

Figure 7:
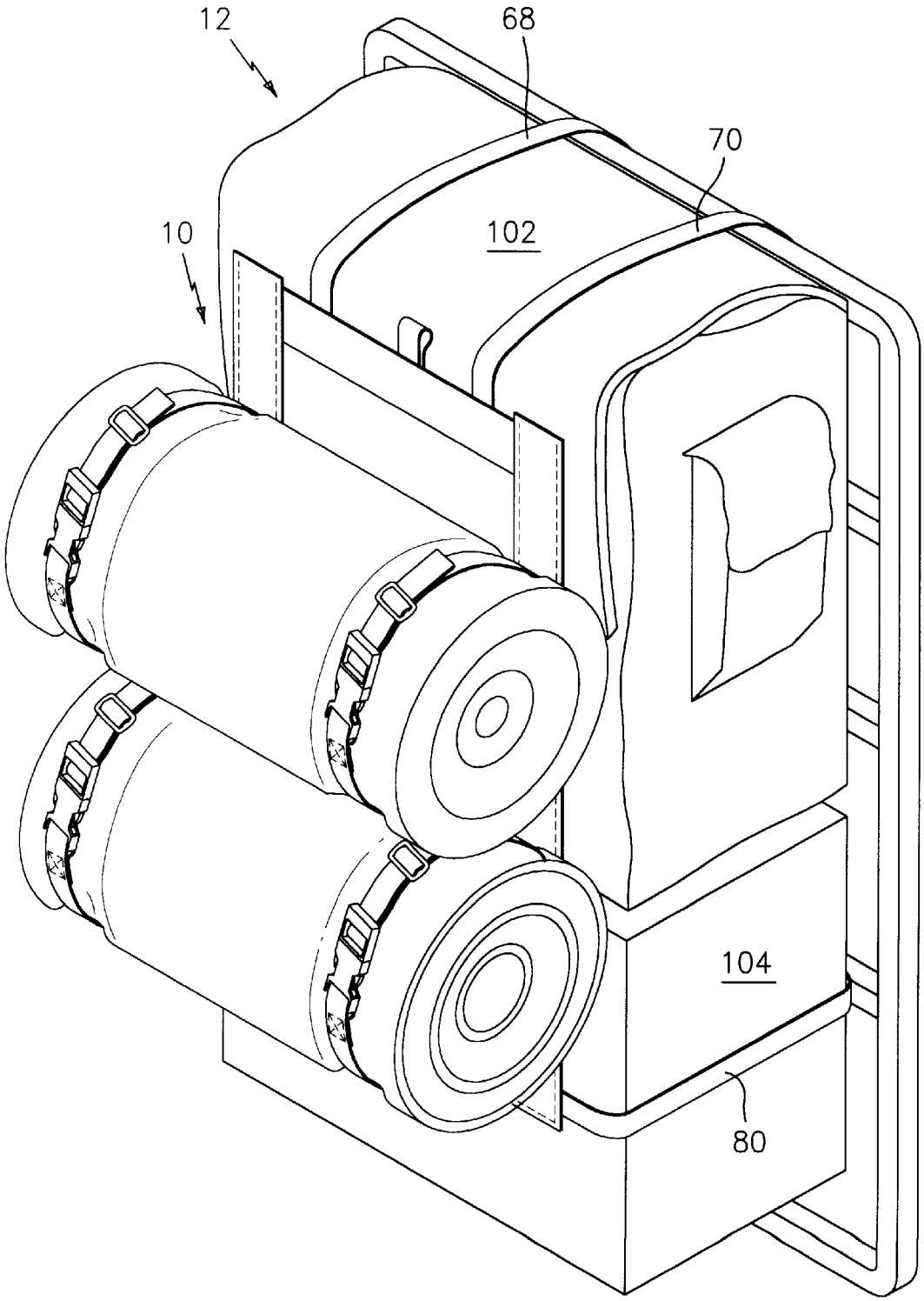
FIG. 7 is a perspective view of the device of the present invention joined to a pack.

FIG. 7 illustrates the device 10 of the present invention connected to a backpack 12 having a plurality of storage compartments 102 and 104. The pack 100 has a plurality of connection devices (not shown), such as D-rings and hooks, to which the straps 68, 70, 78 and 80 can be connected via latch means 74 and 82.

As can be seen from the foregoing description, the device 10 of the present invention provides a number of advantages. First, it is lightweight and easily attachable to and detachable from a pack 12. Second, the device 10 is relatively inexpensive to produce. Still further, the device 10 enhances the ability of a user to carry bulky items such as bed rolls, sleeping bags, blankets, and tents. It also increases the ability of the pack to carry supplies such as food, clothing and medicine.

It is apparent that there has been provided in accordance with this invention an attachment device which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A device for increasing the storage capacity of a pack, said device comprising:

a frame formed from a lightweight flexible material;

means connected to said frame for holding at least one article;

means for attaching said frame with said holding means to a pack to be worn by a user;

said frame having two spaced apart side members;

each of said side members being formed by two layers of fabric material which are joined together so as to form an interior pocket;

said frame having a plurality of cross members each formed from a fabric material;

each of said cross members being substantially perpendicular to said side members;

an uppermost one of said cross members being formed from two fabric layers joined along an edge so as to form an interior space and each of said fabric layers being joined to each of said side members; and said two fabric layers forming said uppermost one of said cross members not being joined to each other along said edge adjacent each end of the cross member so as to form access openings to each of said interior pockets.

2. The device of claim 1, further comprising each of said cross members being joined at their ends to said side members.

3. The device of claim 1, further comprising closure means attached to each of said fabric layers forming said uppermost one of said cross members for closing said interior space.

4. The device of claim 1, wherein said frame further comprises means for rigidifying said frame.

5. The device of claim 1, further comprising:

said holding means comprising adjustable strap means connected to each of said side members having quick connect/disconnect devices for holding at least one object and for releasing said at least one object from said frame for use.

6. The device of claim 5, wherein each of said side members has a plurality of adjustable strap means connected thereto having quick connect/disconnect devices for holding a plurality of objects to said frame and for releasing said objects from said frame for use.

7. The device of claim 1, wherein said attaching means comprises a plurality of adjustable straps each having means for connecting a respective one of said straps to a mechanism on said pack.

8. The device of claim 1, further comprising:

said attaching means comprising a pair of adjustable straps attached to said uppermost one of said cross members and an adjustable strap connected to a lower edge of each of said side members.

9. The device of claim 8, wherein each of said straps has means for connecting said strap to a device on said pack.

10. The combination of claim 1 further comprising:

said attaching means comprising a plurality of straps attached to said uppermost one of said cross members and a strap connected to an end of each said side member and each of said straps having quick connect/disconnect means for joining said frame to said pack.

11. The combination of claim 1 further comprising:

said holding means comprising a plurality of straps connected to each of said side members;

each of said straps having first and second ends with quick connect disconnect devices attached to said ends for forming loops for holding at least one article; and each of said straps having a longitudinal axis which is parallel to a longitudinal axis of the respective side member to which said strap is attached.

12. The device according to claim 1, wherein each of said cross members has first and second ends, wherein each first end is inserted between the two layers forming a first one of said side members and is connected to said first one of said side members by stitching, and wherein each second end is inserted between the two layers forming a second one of said side members and is connected to said second one of said side members by stitching.

13. The device according to claim 11, wherein said holding means comprises at least one loop of material fixed to each of said side members, wherein each said loop of material has a first end and a second end, and wherein each of said first ends has a connection device attached thereto and each of said second ends has a mating connection device attached thereto.

14. The device according to claim 13, wherein each said loop of material is formed by a piece of fabric and each said piece of fabric is connected to a respective side member so that a longitudinal axis of said piece of fabric is parallel to a longitudinal axis of said respective side member.

15. A device for increasing the storage capacity of a pack, said device comprising:

a frame formed from a lightweight flexible material;

means connected to said frame for holding at least one article;

means for attaching said frame with said holding means to a pack to be worn by a user;

said frame having two spaced apart side members;

each of said side members being formed by two layers of fabric material which are joined together so as to form an interior pocket;

said frame having a plurality of cross members each formed from a fabric material;

each of said cross members being substantially perpendicular to said side members;

an uppermost one of said cross members being formed from two fabric layers joined along an edge so as to form an interior space and each of said fabric layers being joined to each of said side members; and said frame further comprising means for rigidifying said frame; and said rigidifying means comprises at least one substantially U-shaped member having a pair of legs and a cross piece, the legs of said at least one substantially U-shaped member are positioned in said interior pockets and said cross piece is seated in said interior space when said at least one substantially U-shaped member is in a rigidifying position.

16. The device of claim 15, wherein said at least one substantially U-shaped member may be removed from said frame and be used independently of said frame.

* * * * *